US008157934B2

(12) United States Patent
Okamoto

(10) Patent No.: US 8,157,934 B2
(45) Date of Patent: Apr. 17, 2012

(54) WEAR-RESISTANT ALUMINUM ALLOY MATERIAL WITH EXCELLENT WORKABILITY AND METHOD FOR PRODUCING THE SAME

(75) Inventor: Yasuo Okamoto, Kitakata (JP)

(73) Assignee: Showa Denko K.K., Tokyo (JP)

( * ) Notice: Subject to any disclaimer, the term of this patent is extended or adjusted under 35 U.S.C. 154(b) by 193 days.

(21) Appl. No.: 12/514,246

(22) PCT Filed: Nov. 8, 2007

(86) PCT No.: PCT/JP2007/071705

§ 371 (c)(1),
(2), (4) Date: May 8, 2009

(87) PCT Pub. No.: WO2008/056738

PCT Pub. Date: May 15, 2008

(65) Prior Publication Data

US 2009/0301616 A1 Dec. 10, 2009

(30) Foreign Application Priority Data

Nov. 10, 2006 (JP) ..... 2006-305169

(51) Int. Cl.
*C22C 21/02* (2006.01)
*C22F 1/04* (2006.01)

(52) U.S. Cl. ..... 148/695; 148/439; 148/698; 148/700; 420/528; 420/529; 420/533; 420/534

(58) Field of Classification Search ..... 148/437–440, 148/695–702; 420/528, 529, 533, 534
See application file for complete search history.

(56) References Cited

U.S. PATENT DOCUMENTS 4,737,206 A * 4/1988 Iwai ..... 148/438
2004/0261615 A1* 12/2004 Yanagimoto et al. ..... 92/208

FOREIGN PATENT DOCUMENTS

| | | |
|---|---|---|
| JP | 60 243241 | 12/1985 |
| JP | 62 44548 | 2/1987 |
| JP | 62 196350 | 8/1987 |
| JP | 1 298131 | 12/1989 |
| JP | 3 111531 | 5/1991 |
| JP | 9 272939 | 10/1997 |

* cited by examiner

*Primary Examiner* — Stanley Silverman
*Assistant Examiner* — Brian Walck
(74) *Attorney, Agent, or Firm* — Oblon, Spivak, McClelland, Maier & Neustadt, L.L.P.

(57) ABSTRACT

A wear-resistant aluminum alloy material excellent in workability and wear-resistance is provided.
A wear-resistant aluminum alloy material excellent in workability includes Si: 13 to 15 mass %, Cu: 5.5 to 9 mass %, Mg: 0.2 to 1 mass %, Ni: 0.5 to 1 mass %, P: 0.003 to 0.03 mass %, and the balance being Al and inevitable impurities. An average particle diameter of primary Si particles is 10 to 30 μm, an area occupancy rate of the primary Si particles in cross-section is 3 to 12%, an average particle diameter of intermetallic compounds is 1.5 to 8 μm, and an area occupancy rate of the intermetallic compounds in cross-section is 4 to 12%.

12 Claims, 1 Drawing Sheet

WEAR-RESISTANT ALUMINUM ALLOY MATERIAL WITH EXCELLENT WORKABILITY AND METHOD FOR PRODUCING THE SAME

TECHNICAL FIELD

The present invention relates to a wear-resistant aluminum alloy material, and more specifically to a wear-resistant aluminum alloy material excellent in workability.

BACKGROUND ART

For example, in an engine cylinder liner and a piston ring for automobiles, they receive sever sliding friction and also repeatedly receive compression stress and tensile stress during the operation. Thus, these members are required to have excellent wear-resistance and burn-resistance.

As an aluminum alloy used for such applications, an aluminum alloy A390 containing about 17% Si has been conventionally used. Furthermore, an aluminum alloy containing more than 17% Si is proposed (see Patent Documents 1 and 2).

As a rotor material, it is proposed to improve the wear-resistance by regulating the alloy compositions and defining the particle diameter of the Si particle (See Patent Document 3).

Patent Document 1: Japanese Unexamined Laid-open Patent Publication No. S62-196350

Patent Document 2: Japanese Unexamined Laid-open Patent Publication No. S62-44548

Patent Document 3: Japanese Unexamined Laid-open Patent Publication No. H03-111531

DISCLOSURE OF THE INVENTION

Problems to be Solved by the Invention

However, there are problems that an aluminum alloy A390 and the aluminum alloys described in the aforementioned Patent Documents 1 and 2 are poor in workability such as cutting workability and shortens tool life due to the high concentration of Si although they are excellent in wear-resistance.

On the other hand, the aluminum alloy material disclosed by Patent Document 3 is lower in Si concentration than A390 aluminum alloy, etc., and therefore improved in workability. Nevertheless, an aluminum alloy improved in both conflicting characteristics, i.e., wear-resistance and workability, has been sought to be provided.

Means to Solve the Problems

In view of the aforementioned technical backgrounds, the present invention aims to provide an aluminum alloy material having both workability and wear-resistance by regulating aluminum alloy compositions and also by controlling the particle diameter and distribution state of primary Si particles and intermetallic compounds.

That is, the wear-resistant aluminum alloy material excellent in workability according to the present invention has the structure as recited in the following items [1] to [6].

[1] A wear-resistant aluminum alloy material excellent in workability consisting of Si: 13 to 15 mass %, Cu: 5.5 to 9 mass %, Mg: 0.2 to 1 mass %, Ni: 0.5 to 1 mass %, P: 0.003 to 0.03 mass %, and the balance being Al and inevitable impurities, wherein an average particle diameter of primary Si particles is 10 to 30 μm, an area occupancy rate of the primary Si particles in cross-section is 3 to 12%, an average particle diameter of intermetallic compounds is 1.5 to 8 μm, and an area occupancy rate of the intermetallic compounds in cross-section is 4 to 12%.

[2] The wear-resistant aluminum alloy material excellent in workability as recited in the aforementioned Item [1], wherein the aluminum alloy further includes at least one of Mn: 0.15 to 0.5 mass % and Fe: 0.1 to 0.5 mass %.

[3] The wear-resistant aluminum alloy material excellent in workability as recited in the aforementioned Item [1] or [2], wherein the average particle diameter of the primary Si particles is 10 to 20 μm.

[4] The wear-resistant aluminum alloy material excellent in workability as recited in any one of the aforementioned Items [1] to [3], wherein the area occupancy rate of the primary Si particles in cross-section is 5 to 8%.

[5] The wear-resistant aluminum alloy material excellent in workability as recited in any one of the aforementioned Items [1] to [4], wherein the average particle diameter of the intermetallic compounds is 2 to 5 μm.

[6] The wear-resistant aluminum alloy material excellent in workability as recited in any one of the aforementioned Items [1] to [5], wherein the area occupancy rate of the intermetallic compounds in cross-section is 5 to 8%.

Furthermore, a production method of the wear-resistant aluminum alloy excellent in workability according to the present invention has the structure as recited in the following Items [7] to [12].

[7] A production method of a wear-resistant aluminum alloy material excellent in workability, wherein an aluminum alloy ingot consisting of Si: 13 to 15 mass %, Cu: 5.5 to 9 mass %, Mg: 0.2 to 1 mass %, Ni: 0.5 to 1 mass %, P: 0.003 to 0.03 mass %, and the balance being Al and inevitable impurities is subjected to homogenization treatment of 3 to 12 hours at 450 to 500° C.

[8] The production method of a wear-resistant aluminum alloy material excellent in workability as recited in the aforementioned Item [7], wherein the aluminum alloy ingot further includes at least one of Mn: 0.15 to 0.5 mass % and Fe: 0.1 to 0.5 mass %.

[9] The production method of a wear-resistant aluminum alloy material excellent in workability as recited in the aforementioned Item [7] or [8], wherein the homogenization treatment is performed under the conditions of exceeding 470° C. but lower than 500° C. for 4 to 8 hours.

[10] The production method of a wear-resistant aluminum alloy material excellent in workability as recited in any one of the aforementioned Items [7] to [9], wherein the aluminum alloy ingot subjected to the homogenization treatment is subjected to at least one of machine work and plastic working.

[11] The production method of a wear-resistant aluminum alloy material excellent in workability as recited in the aforementioned Item [10], wherein the machine work is cutting.

[12] The production method of a wear-resistant aluminum alloy material excellent in workability as recited in the aforementioned Item [10] or [11], wherein the plastic working is forging.

Effects of the Invention

According to the wear-resistant aluminum alloy material excellent in workability as recited in the aforementioned Item [1], the workability is improved by the lowered Si concentration in the alloy compositions, and the wear-resistance and the burn-resistance are complemented by the intermetallic compounds formed by adding Cu and Ni. Furthermore, excellent softening-resistance can be attained by the addition of Cu and Ni. In addition, since the average particle diameter and area occupancy rate of the primary Si particles and intermetallic compounds are regulated so as to fall within the respective prescribed ranges, excellent workability, wear-resistance, burn-resistance, and softening-resistance can be attained. Furthermore, the addition of P enables suppression of deterioration in forgeability, ductibility and fatigue strength.

According to each wear-resistant aluminum alloy material excellent in workability as recited in the aforementioned Items [2], [3], [4], [5], and [6], especially excellent wear-resistance and burn-resistance can be obtained.

According to the production method of a wear-resistant aluminum alloy excellent in workability as recited in the aforementioned Item [7], the average particle diameter and area occupancy rate of the primary Si particles and intermetallic compounds are set so as to fall within the respective ranges as recited in the aforementioned Item [1]. This makes it possible to produce an aluminum alloy material having excellent workability, wear-resistance, burn-resistance, and softening-resistance and suppressed in forgeability, ductibility, and fatigue strength.

According to the production method of a wear-resistant aluminum alloy material excellent in workability as recited in the aforementioned Items [8] and [9], a wear-resistant aluminum alloy material especially excellent in wear-resistance and burn-resistance can be produced.

According to the production method of each wear-resistant aluminum alloy material excellent in workability as recited in the aforementioned Items [10], [11], and [12], an aluminum alloy material of a desired shape having excellent workability, wear-resistance, burn-resistance, and softening-resistance and suppressed in forgeability, ductibility, and fatigue strength can be produced.

DESCRIPTION OF REFERENCE NUMERALS

Figure 1A:
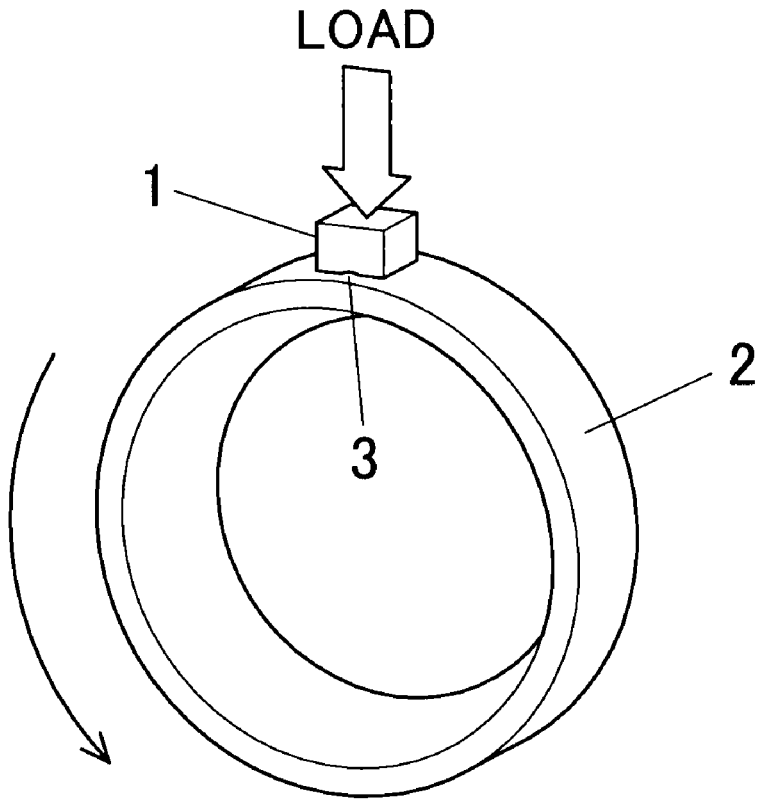
FIG. 1A is a perspective view showing a Block-on-Ring test method.

1 . . . test piece
2 . . . ring
3 . . . wear track

BEST MODE FOR CARRYING OUT THE INVENTION

A wear-resistant aluminum alloy material excellent in workability according to the present invention (hereinafter abbreviated as "aluminum alloy material") is an alloy material excellent both in workability and wear-resistance in which the alloy composition is regulated and that the particle diameter and distribution state of the primary Si particles and those of the intermetallic compounds in the metallic structure are controlled.

The aluminum alloy is improved in workability by decreasing the Si concentration than that of conventional wear-resistant aluminum alloys and complemented the wear-resistance, which deteriorates in accordance with the Si concentration reduction, by intermetallic compounds formed by adding Cu and Ni.

The aluminum alloy composition contains Si, Cu, Mg, Ni and P as essential elements, and further contains Mn and Fe arbitrarily. Hereinafter, the reasons for adding each element of the aluminum alloy constituting the aluminum alloy material and limiting the concentration thereof will be explained as follows.

Si is an element which enhances wear-resistance and burn-resistance by distribution of primary Si and eutectic Si and coexists with Mg to increase mechanical strength by precipitating $Mg_2Si$ particles with Mg, and the concentration is set to 13 to 15 mass %. If the Si concentration is less than 13 mass %, the aforementioned effects are insufficient. If the concentration exceeds 15 mass %, more primary Si will be crystallized, which may deteriorate ductility and toughness to cause deterioration of workability and/or may deteriorate fatigue strength. The preferred Si concentration is 13.5 to 14.5 mass %.

Cu is an element which enhances wear-resistance, burn-resistance, and softening-resistance by forming Al—Cu series crystallized products or Al—Ni—Cu series crystallized products with coexisted Ni, and also improves mechanical strength by causing precipitation of $CuAl_2$ particles. The Cu concentration is set to 5.5 to 9 mass %. If the Cu concentration is less than 5.5 mass %, the aforementioned effects are insufficient. If the concentration exceeds 9 mass %, Al—Cu series or Al—Ni—Cu series coarse crystallized products increases, which may cause deterioration of forgeability, ductility and toughness to deteriorate workability and/or may cause deterioration of fatigue strength. The preferred Cu concentration is 7 to 9 mass %.

Mg is an element which enhances mechanical strength by causing precipitation of $Mg_2Si$ particles with coexisted Si. The Mg concentration is set to 0.2 to 1 mass %. If the Mg concentration is less than 0.2 mass %, the aforementioned effects are insufficient. If the concentration exceeds 1 mass %, $Mg_2Si$ series coarse crystallized products increases, which may deteriorate forgeability, ductility and toughness to cause deterioration of workability and/or may deteriorate fatigue strength. The preferred Mg concentration is 0.3 to 0.7 mass %.

Ni is an element which enhances wear-resistance, burn-resistance, and softening-resistance by forming Al—Ni series crystallized products or Al—Ni—Cu series crystallized products with coexisted Ni. The Ni concentration is set to 0.5 to 1 mass %. If the Ni concentration is less than 0.5 mass %, the aforementioned effects are insufficient. If the concentration exceeds 1 mass %, coarse crystallized products will be increased, which may deteriorate forgeability, ductility and toughness to cause deterioration of workability and/or may deteriorate fatigue strength. The preferred Ni concentration is 0.65 to 0.85 mass %.

P is an element which enhances wear-resistance and burn-resistance by miniaturizing primary Si and also suppresses deterioration of forgeability, ductility and fatigue strength. The P concentration is set to 0.003 to 0.03 mass %. If the P concentration is less than 0.003 mass %, the effect of miniaturizing the primary Si size becomes less effective. If the concentration exceeds 0.03 mass %, AlP particles increases, which may causes deterioration of forgeability, ductility and toughness to deteriorate workability. The preferred P concentration is 0.003 to 0.02 mass %.

Mn and Fe are elements which enhance wear-resistance and burn-resistance by crystallizing Al—Mn series particles, Al—Fe—Mn—Si series particles, Al—Fe series particles, Al—Fe—Si series particles, and Al—Ni—Fe series particles. Addition of at least one of Mn and Fe enables attaining the aforementioned effects. The Mn concentration is set to 0.15 to 0.5 mass %, and the Fe concentration is set to 0.1 to 0.5 mass %. If the Mn concentration is less than 0.15 mass % or Fe concentration is less than 0.1 mass %, the aforementioned effects are insufficient. If the Mn concentration or Fe concentration exceeds 0.5 mass %, coarse crystallized products increase, which may cause deterioration of forgeability, ductility and toughness to deteriorate workability and/or may cause deterioration of fatigue strength. The preferred Mn concentration is 0.15 to 0.3 mass %, and the preferred Fe concentration is 0.1 to 0.3 mass %.

By adding Cu and Ni, deterioration of hardness of the aluminum alloy material can be suppressed even if the aluminum alloy material is disposed in a high temperature atmosphere. The enhanced softening-resistance at a high temperature suppresses hardness deterioration of the aluminum alloy material even in cases where the aluminum alloy material is subjected to high temperature surface treatment.

In the aluminum alloy composition, the remaining elements are Al and inevitable impurities.

In the metallic structure of the aluminum alloy material of the present invention, the primary Si particles and intermetallic compounds affect workability, wear-resistance, and burn-resistance. Hereinafter, the particle diameters of primary Si particles and intermetallic compounds, and the particle diameter and area occupancy rate of the intermetallic compounds will be detailed.

The primary Si particle is set to 10 to 30 μm in average particle diameter. If the average particle diameter is less than 10 μm, wear-resistance and burn-resistance deteriorate. If it exceeds 30 μm, foregeability and cutting workability deteriorate, resulting in poor workability. The preferred average particle diameter of primary Si particles is 10 to 20 μm. Furthermore, the area occupancy rate of the primary Si particles is set to 3 to 12%. If the area occupancy rate is less than 3%, wear-resistance and burn-resistance deteriorate. If it exceeds 12%, forgeability and cutting workability deteriorate, resulting in poor workability. The preferred area occupancy rate of the primary Si particles is 5 to 8%.

In an aluminum alloy material, metallic compounds which affect workability, wear-resistance and burn-resistance are Al—Ni series compounds, Al—Cu—Ni series compounds, Al—Ni—Fe series compounds, $CuAl_2$, Al—(Fe, Mn)—Si series compounds. The average particle diameter and area occupancy rate of these intermetallic compounds are regulated.

The average particle diameter of the intermetallic compounds is 1.5 to 8 μm. If the average particle diameter is less than 1.5 μm, wear-resistance and burn-resistance deteriorate. If it exceeds 8 μm, forgeability and cutting workability deteriorate, resulting in poor workability. The preferred average particle diameter of intermetallic compounds is 2 to 5 μm. Furthermore, the area occupancy rate of the intermetallic compounds is set to 4 to 12%. If the area occupancy rate is less than 4%, wear-resistance and burn-resistance deteriorate. If it exceeds 12%, forgeability and cutting workability deteriorate, resulting in poor workability. The preferred area occupancy rate of intermetallic compounds is 5 to 8%.

In the aluminum alloy material according to the present invention, $Mg_2Si$ is also formed. However, the crystallized amount of $Mg_2Si$ is small when Mg falls within the range of the aforementioned concentration, which exerts less influence on the workability, wear-resistance, and burn-resistance than the aforementioned intermetallic compounds.

The aforementioned aluminum alloy material of the present invention can be produced by performing homogenization treatment to an aluminum alloy ingot having the aforementioned chemical compositions under a given condition. In other words, the particle diameter and area occupancy rate of primary Si particles and intermetallic compounds are controlled by homogenization treatment.

The production method of an ingot is not specifically limited. The present invention allows various continuous casting methods, such as, e.g., a hot-top continuous casting method and a horizontal continuous casting method. In the present invention, an ingot formed by solidifying an aluminum alloy material in a casting mold can also be used.

In performing the casting, it is preferable that the casting rate which is a drawing rate of drawing an ingot from a casting mold is 80 to 1,000 mm/min. (more preferably 200 to 1,000 mm/min.) because the primary Si particles become even and fine, which in turn can enhance forgeability, cutting workability, wear-resistance, and burn-resistance. Needless to say, the functions and effects of the present invention are not limited by the casting rate. However, the slower casting rate enhances the effects. Furthermore, it is preferable that the average temperature of the molten alloy flowing into a casting mold is set to a temperature higher than the liquidus line by 60 to 230° C. (more preferably 80 to 200° C.). If the molten alloy temperature is too low, coarse primary Si particles are formed, causing deterioration of forgeability and/or cutting workability. If the temperature is too high, a large amount of hydrogen gas may be introduced into the molten alloy, causing porocities in an ingot to deteriorate foregeability and cutting workability.

The homogenization treatment is performed by maintaining the aluminum alloy ingot at a temperature of 450 to 500° C. for 3 to 12 hours. If the treatment temperature is lower than 450° C., the average particle diameter of the intermetallic compounds may become small to cause deterioration of wear-resistance and burn-resistance. If it exceeds 500° C., eutectic melting may occur. Furthermore, if the treating time is less than 3 hours, the average particle diameter of intermetallic compounds becomes small to cause deterioration of wear-resistance and burn-resistance. If it exceeds 12 hours, the production cost increases. It is preferable to perform homogenization treatment under the conditions of 4 to 8 hours at a temperature of 470° C. or above but not exceeding 500° C.

The ingot subjected to the homogenization treatment is formed and shaped into a desired shape by machining and/or plastic working. The processing method is not specifically limited. As the machining, cut-off work and cutting work can be exemplified. As the plastic working, forging, extruding, and rolling can be exemplified. One of the aforementioned processing methods or any combination thereof enable the ingot to be formed and shaped into any desired shape. The metallic structure of the ingot is formed so that the particle diameters and area occupancy rate of the primary Si particles and intermetallic compounds fall within the aforementioned range. Therefore, the workability is good, resulting in reduced processing energy and improved dimensional accuracy of a formed article. Furthermore, in machining, a tool life can be extended.

A formed article formed into a given shape is subjected to a heat treatment, such as, e.g., a solution treatment or an aging treatment, to improve the characteristics of the aluminum alloy material if needed. The solution treatment is preferably performed under the conditions of 1 to 3 hours at 480 to 500° C., and the quenching is preferably performed by water cooling using water of 60° C. or below. The aging is preferably performed by holding the article for 1 to 16 hours at 150 to 230° C.

The aforementioned heat treatment hardly causes changes in the average particle diameter and area occupancy rate of the primary Si particles. Furthermore, the changes of the average particle diameter and area occupancy rate of the intermetallic compounds are slight, and the aforementioned metallic structure gives excellent wear-resistance, burn-resistance, and softening-resistance. Therefore, the aluminum alloy material according to the present invention includes all of an aluminum alloy material subjected to homogenization treatment but not subjected to shape forming, an aluminum alloy material subjected to shape forming into a given shape, and an aluminum alloy material subjected to heat treatment. The aluminum alloy material is not specifically limited in shape.

Between the ingot production and the shape forming to a final shape, any well-known steps can be performed. For example, a step for correcting the straightness and/or roundness of a continuously casted article, a step for removing uneven layers and/or inner defects, and a step for inspecting the surface and inside of the ingot can be performed arbitrarily.

The aluminum alloy material of the present invention is excellent in wear-resistance and burn-resistance, and therefore can be preferably used as slide members which readily cause burning phenomena, more specifically, as slide members which readily cause burning phenomena at the time of starting when lubricant agent are not sufficiently circulated. Specifically, the examples include valve spools and valve sleeves for automatic transmissions, brake caliper pistons, brake calipers, pump covers for power steerings, engine cylinder liners, and swash plates for car air-conditioning compressors.

EXAMPLES

Round bars of 80 mm in diameter made of the aluminum alloy having the composition shown in Table 1 was continuously casted, then cut into a given length, and subjected to homogenization treatment under the condition shown in Table 1. Thereafter, the continuously casted round bar subjected to the homogenization treatment was cut into a thickness of 30 mm with a superhard chip saw. Next, the material having a thickness of 30 mm was pre-heated to 420° C. and then swaged into a thickness of 15 mm. Thereafter, the swaged article was subjected to solution treatment for 3 hours at 495° C., water-cooled, and further subjected to aging treatment for 6 hours at 190° C.

TABLE 1

| | | Alloy composition (mass %), Balance: Al and inevitable impurities | | | | | | | Homogenization |
|---|---|---|---|---|---|---|---|---|---|
| | | Si | Fe | Cu | Mn | Mg | Ni | P | treatment |
| Example | 1 | 14.1 | 0.25 | 5.5 | 0.23 | 0.61 | 0.73 | 0.008 | 490° C. × 7 hours |
| | 2 | 14.2 | 0.23 | 8.0 | 0.01 | 0.58 | 0.79 | 0.008 | 490° C. × 7 hours |
| | 3 | 13.1 | 0.24 | 7.1 | 0.47 | 0.55 | 0.52 | 0.007 | 470° C. × 4 hours |
| | 4 | 15.0 | 0.48 | 9.0 | 0.25 | 0.54 | 0.96 | 0.008 | 450° C. × 12 hours |
| | 5 | 14.1 | 0.25 | 7.5 | — | 0.61 | 0.73 | 0.009 | 480° C. × 5 hours |
| | 6 | 14.2 | — | 8.0 | 0.23 | 0.58 | 0.79 | 0.007 | 490° C. × 7 hours |
| | 7 | 14.2 | — | 8.0 | — | 0.58 | 0.79 | 0.007 | 480° C. × 5 hours |
| | 8 | 14.2 | — | 8.5 | — | 0.58 | 0.79 | 0.008 | 490° C. × 7 hours |
| Comparative Example | 1 | 16.4 | 0.26 | 4.4 | 0.05 | 0.54 | 0.08 | 0.007 | 490° C. × 7 hours |
| | 2 | 14.1 | 0.27 | 4.4 | 0.05 | 0.51 | 0.02 | 0.008 | 495° C. × 4 hours |
| | 3 | 14.3 | 0.25 | 7.9 | 0.03 | 0.58 | 0.80 | 0.008 | 430° C. × 3 hours |

As to the continuously casted round bar subjected to the homogenization treatment and the swaged article subjected to the aging treatment in the aforementioned steps, the average particle diameter and area occupancy rate of the primary Si particles and those of the intermetallic compounds were measured. As to the continuously casted round bar subjected to the homogenization treatment, the cutting workability and the forgeability were evaluated by the following method. Furthermore, as to the swaged article subjected to the aging treatment, the burn-resistance, wear-resistance, and softening-resistance were evaluated by the following method. These evaluation results are shown in Tables 2 and 3.

[Average Particle Diameter and Area Occupancy Rate of Primary Si Particles and Intermetallic Compounds]

As to the continuous casted round bar subjected the homogenization treatment, structure observing samples were cut out from the vertical cross-sectional intermediate portion between the external peripheral portion and the center portion thereof. Furthermore, as to the swaged article, structure observing samples were cut out from the intermediate portion between the cross-sectional external peripheral portion in the thickness direction and the central portion thereof. These samples were micro-polished. As to the micro structure observed with a metallographic microscope, the average particle diameter and area occupancy rate of the primary Si particles and those of the intermetallic compounds were measured with an image processing apparatus.

[Cutting Workability]

At the time of cutting the continuously casted round bar subjected to the homogenization treatment into a thickness of 30 mm with a superhard chip saw, the maximum load electric power W during the cutting process was measured with a motor sensor.

[Forgeability]

After the homogenization treatment, a test piece 15 mm in diameter and 2 mm in height was cut out from the continuously casted round bar. The test piece was heated to 350° C., and then swaged into each thickness with a 630 t mechanical press. In this test, the limit swaging rate (%) in which no cracks generate in the test piece was investigated.

[Burn-Resistance]

The evaluation was made by the Block-on-Ring test shown in FIG. 1A.

A test piece 1 was obtained by cutting out from the intermediate portion of the swaged article in the radial direction and in the height direction from the external peripheral portion into block having a length of 15.76 mm, a width of 6.36 mm, and a height of 10 mm. The ring 2 was made of high-chrome steel (JIS G4805 SUJ2) and had an external diameter of 35 mm and a width of 8.7 mm. The inner peripheral portion was tapered with one end side inner diameter of 31.2 mm and the other end side inner diameter of 25.9 mm.

The test atmosphere was set in a room temperature. A brake fluid as a lubricant was applied to the test piece 1 and the ring 2. The test piece 1 was brought into contact with the rotating ring 2 with a load to cause a sliding movement between the test piece 1 and the ring 2. While keeping the revolution rate of the ring 2 constant at 340 rpm, the test was initiated from the load of 200 N by increasing a load by 200 N every 5 minutes up to 400 N to investigate the burning load at which the torque rapidly increases.

[Wear-Resistance]

Figure 1B:
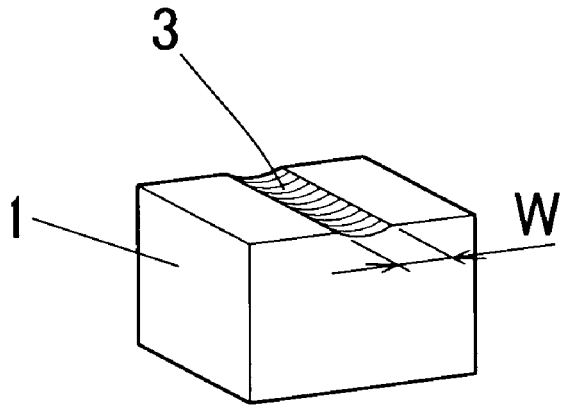
FIG. 1B is a perspective view showing a wear-resistance evaluation method by the Block-on-Ring test method.

In the same manner as in the aforementioned burning-resistance test, a test piece 1 was produced from the swaged article. Using the same ring 2, a Block-on-Ring test was performed with the ring 2 immersed in a brake fluid up to ⅔ of the height of the ring. In this test, in accordance with the revolution of the ring 2, the brake fluid was lifted up to the height of the test piece 1. A wear test was performed for 10 minutes at a test load: 1,300 N at the revolution rate of the ring 2: 340 rpm to measure the width W of the wear track 3 formed on the test piece 1 (see FIG. 1B).

[Softening-Resistance]

After heating the swaged articles of Examples 2 and 3 and Comparative Example 1 for 60 minutes or 120 minutes at 240° C. and 280° C., the hardness $H_{RB}$ was measured and compared with the hardness before heating (heating: 0 minute in Table).

TABLE 2

| | | Primary Si particle | | Intermetallic compound | | Workability | |
|---|---|---|---|---|---|---|---|
| | | Average particle diameter (μm) | Area occupancy rate (%) | Average particle diameter (μm) | Area occupancy rate (%) | Cutting maximum load electric power (W) | 350° C. limit swaging rate (%) |
| Example | 1 | 14.0 | 5.6 | 2.0 | 5.9 | 2,778 | 55 |
| | 2 | 17.8 | 6.5 | 2.1 | 6.7 | 2,792 | 54 |
| | 3 | 17.0 | 6.3 | 2.0 | 6.1 | 2,781 | 59 |
| | 4 | 18.1 | 6.6 | 2.3 | 7.8 | 2,800 | 53 |
| | 5 | 16.5 | 6.0 | 2.0 | 6.3 | 2,782 | 54 |
| | 6 | 17.0 | 6.1 | 2.1 | 6.4 | 2,784 | 54 |
| | 7 | 17.5 | 6.2 | 2.1 | 6.6 | 2,790 | 54 |
| | 8 | 17.7 | 6.4 | 2.2 | 7.0 | 2,795 | 53 |
| Comparative | 1 | 17.0 | 9.3 | 1.5 | 3.6 | 3,006 | 49 |
| Example | 2 | 11.3 | 4.9 | 1.6 | 3.8 | 2,713 | 57 |
| | 3 | 17.5 | 6.2 | 1.1 | 5.3 | 2,737 | 54 |

TABLE 3

| | | Primary Si particle | | Intermetallic compound | | | Wear-resistance | Softening-resistance | | | | | |
|---|---|---|---|---|---|---|---|---|---|---|---|---|---|
| | | Average | Area | Average | Area | Burn-resistance | Wear | 240° C. | | | 280° C. | | |
| | | particle diameter (μm) | occupancy rate (%) | particle diameter (μm) | occupancy rate (%) | Burning load (N) | trace W (mm) | 0 min. | 60 min. | 120 min. | 0 min. | 60 min. | 120 min. |
| Example | 1 | 16.5 | 5.3 | 2.1 | 4.3 | No buring | 0.77 | | | | | | |
| | 2 | 18.1 | 6.8 | 1.7 | 6.6 | No burning | 0.76 | 85.9 | 79.7 | 76.9 | 85.9 | 63.2 | 62.0 |
| | 3 | 17.2 | 6.4 | 1.8 | 6.1 | No burning | 0.78 | 85.6 | 78.8 | 75.8 | 85.6 | 62.1 | 60.8 |
| | 4 | 18.5 | 7.0 | 2.2 | 7.5 | No burning | 0.72 | | | | | | |
| | 5 | 16.7 | 5.9 | 1.7 | 6.2 | No burning | 0.77 | | | | | | |
| | 6 | 17.3 | 5.9 | 1.8 | 6.4 | No burning | 0.75 | | | | | | |
| | 7 | 17.6 | 6.1 | 1.7 | 6.5 | No burning | 0.74 | | | | | | |
| | 8 | 18.0 | 6.3 | 1.8 | 7.0 | No burning | 0.73 | | | | | | |
| Comparative | 1 | 17.5 | 8.8 | 1.4 | 3.4 | No burning | 0.71 | 85.1 | 77.2 | 74.0 | 85.1 | 59.1 | 57.2 |
| Example | 2 | 12.2 | 4.8 | 1.4 | 3.7 | 1,400 | 0.92 | | | | | | |
| | 3 | 17.7 | 6.1 | 1.4 | 5.5 | 1,400 | 0.87 | | | | | | |

From the results shown in Tables 2 and 3, it was confirmed that excellent workability, wear-resistance, burn-resistance, softening-resistance can be attained by regulating the alloy composition, the average particle diameter and area occupancy rate of the primary Si particles, the average particle diameter and area occupancy rate of the intermetallic compounds.

This application claims priority to Japanese Patent Application No. 2006-30516 filed on Nov. 10, 2006, the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The wear-resistance aluminum alloy material according to the present invention is excellent in workability, and therefore can be preferably used as various sliding members by forming into a given shape.

The invention claimed is:

1. A wear-resistant aluminum alloy material comprising:

an alloy having a composition comprising 13 to 15 mass % of silicon, 5.5 to 9 mass % of copper, 0.2 to 1 mass % of magnesium, 0.5 to 1 mass % of nickel, and 0.003 to 0.03 mass % of phosphorous, the alloy comprising aluminum and inevitable impurities constituting balance of the composition, wherein the alloy comprises primary silicon particles and intermetallic compounds, the primary silicon particles have an average particle diameter of 10 to 30 μm and an area occupancy rate in cross-section of 3 to 12%, and the intermetallic compounds have an average particle diameter of 1.5 to 8 μm and an area occupancy rate in cross-section of 4 to 12%.

2. The wear-resistant aluminum alloy material as recited in claim 1, wherein the alloy has the composition comprising at least one of 0.15 to 0.5 mass % of manganese and 0.1 to 0.5 mass % of iron.

3. The wear-resistant aluminum alloy material as recited in claim 1, wherein the primary silicon particles have the average particle diameter of 10 to 20 μm.

4. The wear-resistant aluminum alloy material as recited in claim 1, wherein the primary silicon particles have the area occupancy rate in a cross-section of 5 to 8%.

5. The wear-resistant aluminum alloy material as recited in claim 1, wherein the intermetallic compounds have the average particle diameter of 2 to 5 μm.

6. The wear-resistant aluminum alloy material as recited in claim 1, wherein the intermetallic compounds have the area occupancy rate in cross-section of 5 to 8%.

7. A method of producing a wear-resistant aluminum alloy material, comprising:

subjecting an aluminum alloy ingot to a homogenization treatment of 3 to 12 hours at −450 to 500° C. such that an alloy material is formed, wherein the aluminum alloy ingot has a composition comprising 13 to 15 mass % of silicon, 5.5 to 9 mass % of copper, 0.2 to 1 mass % of magnesium, 0.5 to 1 mass % of nickel, and 0.003 to 0.03 mass % of phosphorous, and the aluminum alloy ingot comprises aluminum and inevitable impurities constituting balance of the composition, and wherein the alloy material comprises primary silicon particles and intermetallic compounds, the primary silicon particles have an average particle diameter of 10 to 30 μm and an area occupancy rate in cross-section of 3 to 12%, and the intermetallic compounds have an average particle diameter of 1.5 to 8 μm and an area occupancy rate in cross-section of 4 to 12%.

8. The method as recited in claim 7, wherein the aluminum alloy ingot has the composition comprising at least one of 0.15 to 0.5 mass % of manganese and 0.1 to 0.5 mass % of iron.

9. The method as recited in claim 7, wherein the homogenization treatment is performed under the conditions of exceeding 470° C. but lower than 500° C. for 4 to 8 hours.

10. The method as recited in claim 7, wherein the aluminum alloy ingot subjected to the homogenization treatment is subjected to at least one of machine work and plastic working.

11. The method as recited in claim 10, wherein the machine work is cutting.

12. The method as recited in claim 10, wherein the plastic working is forging.

* * * * *